US009572234B2

(12) United States Patent
Stefanoff et al.

(10) Patent No.: US 9,572,234 B2
(45) Date of Patent: Feb. 14, 2017

(54) LED CONTROL MODULE

(76) Inventors: Dana D. Stefanoff, Collinsville, OK (US); Buddy A. Stefanoff, Collinsville, OK (US)

( * ) Notice: Subject to any disclaimer, the term of this patent is extended or adjusted under 35 U.S.C. 154(b) by 0 days.

(21) Appl. No.: 13/561,407

(22) Filed: Jul. 30, 2012

(65) Prior Publication Data

US 2013/0026934 A1 Jan. 31, 2013

Related U.S. Application Data

(60) Provisional application No. 61/513,214, filed on Jul. 29, 2011.

(51) Int. Cl.
*H05B 37/02* (2006.01)

(52) U.S. Cl.
CPC ..... *H05B 37/0245* (2013.01)

(58) Field of Classification Search
CPC . H05B 37/0245; H05B 37/02; H05B 41/3925; H05B 41/391; H05B 41/2828; H05B 33/0803
USPC ..... 315/193, 51, 185 R, 294, 227, 307; 362/227
See application file for complete search history.

(56) References Cited

U.S. PATENT DOCUMENTS

| | | | | |
|---|---|---|---|---|
| 6,340,868 | B1 * | 1/2002 | Lys et al. | 315/185 S |
| 6,577,080 | B2 * | 6/2003 | Lys et al. | 315/362 |
| 7,781,979 | B2 * | 8/2010 | Lys | 315/185 S |
| 7,961,113 | B2 * | 6/2011 | Rabiner et al. | 340/4.21 |
| 7,976,196 | B2 * | 7/2011 | Ivey et al. | 362/294 |
| 7,999,491 | B2 * | 8/2011 | Peng et al. | 315/291 |
| 8,004,211 | B2 * | 8/2011 | Van Erp | 315/294 |
| 8,674,626 | B2 * | 3/2014 | Siemiet et al. | 315/308 |
| 2002/0057061 | A1 * | 5/2002 | Mueller et al. | 315/291 |
| 2007/0291483 | A1 * | 12/2007 | Lys | 362/227 |
| 2009/0219305 | A1 * | 9/2009 | Diederiks et al. | 345/690 |
| 2011/0035404 | A1 * | 2/2011 | Morgan et al. | 707/769 |
| 2011/0089852 | A1 * | 4/2011 | Segan | 315/250 |
| 2011/0299854 | A1 * | 12/2011 | Jonsson et al. | 398/106 |

OTHER PUBLICATIONS

"3-Channel Constant Current LED Driver with Programmable PWM Control",A6281, 2006, Publisher: Allegro MicroSystems, Inc.; A6281-DS, Rev. 1.

"Moonstone Tri-Color Power LED Light Source", ASMT-MT00 Data Sheet, Aug. 6, 2009, Publisher: Avago Technologies; AV02-1693EN.

"1A 60W* Common Anode Capable Constant Current Buck LED Driver Requires No External Current Sensing Resistor", LM3414/LM3414HV Aug. 9, 2010, Publisher: National Semiconductor Corporation; 301248.

* cited by examiner

*Primary Examiner* — Douglas W Owens
*Assistant Examiner* — Syed M Kaiser
(74) *Attorney, Agent, or Firm* — Lexigent LLC; John M. Behles

(57) ABSTRACT

A lighting system including a lighting module that receives a digital instruction stream containing lighting instructions, extracts a portion of the stream, provides a remainder of the stream to a connected adjacent lighting module, and executes the extracted portion.

19 Claims, 3 Drawing Sheets

LED CONTROL MODULE

CROSS REFERENCE TO RELATED APPLICATIONS

This application claims the priority of U.S. Provisional Patent Application No. 61/513,214 entitled "LED CONTROL MODULE," filed Jul. 29, 2011, the contents of which are hereby incorporated by reference.

FIELD OF THE INVENTION

This disclosure relates to lighting control systems and, more particularly, to an address-less LED lighting control system.

BACKGROUND OF THE INVENTION

Certain devices and locations have always benefitted from decorative lighting. Amusement park rides, arcades, and performance venues are examples of locations where decorative lighting has long been employed. Some decorative lighting is very simple. Lights may be illuminated or flashed on and off. If a bulb or device fails it may be replaced. However, it is often desired to have more complicated effects that are more visually interesting. It may also be desirable to time lighting to music or other events.

Where a particular segment or portion of a display is intended to be illuminated or operated differently than a neighboring segment, addressing schemes have been utilized. A lighting appliance or group of appliances may be assigned an address. A lighting device may only respond to commands issued on a system bus if the command contains its address. In other configurations, the bus may only deliver commands to a lighting device with a known address. In addition to lengthy and error prone setup times, systems such as these may suffer unacceptable downtime if one or more devices on the bus fails. At the very least, the replacement device must be programmed with the correct address. In some cases, the entire system may have to be readdressed.

What is needed is a system and method that addresses the above and related issues.

SUMMARY OF THE INVENTION

The invention of the present disclosure, in one aspect thereof comprises a lighting system including a lighting module that receives a digital instruction stream containing lighting instructions, extracts a portion of the stream, provides a remainder of the stream to a connected adjacent lighting module, and executes the extracted portion.

In some embodiments, the lighting module further comprises a light emitting diode (LED) driver that receives the instruction stream, extracts the portion of the stream, and provides the remainder of the stream to the connected adjacent lighting module. The lighting module may also comprise a digital switch connected to the LED driver, and at least one LED attached to the digital switch, the digital switch providing electrical energy for powering the at least one LED in response to a signal from the LED driver. In some cases, the at least one LED comprises a plurality of LEDs of a plurality of colors.

The lighting module may also comprise a weather-sealed partially transparent tube containing a plurality of light emitting diodes (LEDs). The lighting module may comprises at least one LED driver within the tube that receives the digital instruction stream, extracts the portion of the stream, and provides a remainder of the stream to a connected adjacent lighting module. At least one digital switch may be within the tube and connected between the LED driver at least one of the plurality of LEDs, the LED driver executing the extracted portion of the stream via control of the digital switch to selectively illuminate the plurality of LEDs. The LED driver may control the digital switch via pulse width modulation.

In some embodiments, the system further comprising a digital controller communicatively coupled to the lighting module and providing the digital instruction stream to the lighting module. In some embodiments, the digital instruction stream does not contain addressing information. The extracted portion of the digital instruction stream may contain digital information corresponding to a color to be illuminated, a control signal, an intensity, and a dot color correction. The digital controller may receive the instruction stream via the Internet and/or wirelessly.

The invention of the present disclosure, in another embodiment thereof, comprises an address-less lighting system having a plurality of lighting modules, each comprising a light emitting diode (LED) driver, a digital switch coupled to the LED driver, and at least one LED coupled to the digital switch. The system includes system controller providing a digital data instruction stream to the plurality of lighting modules without addressing data. The plurality of lighting module are connected in a serial chained configuration, a first lighting module in the chain receiving the digital data instruction stream from the system controller, extracting a portion of the received digital data instruction stream for use by the first module in the chain and passing a remainder of the data to a next lighting module in the chain.

In some embodiments, each of the plurality of lighting modules contains the LED driver, the digital switch, and the at least one LED in a weather proof enclosure. The digital controller may obtain a count of a number of lighting modules connected in the serial chained configuration before providing the digital data instruction stream. The digital data instruction stream may contain a series of data blocks, each data block in the series containing an address-less lighting instruction set for a corresponding one of the plurality of lighting modules in the serial chained configuration.

The invention of the present disclosure, in another embodiment thereof, comprises a method of controlling a plurality of lighting modules, each module having a plurality of lights that may be illuminated in a plurality of ways. The method comprises designating a first instruction block for a first of the plurality of lighting modules and a second instruction block for a second of the plurality of lighting modules, appending the second instruction block to the first instruction block to create a data stream, providing the data stream to the first of the plurality of lighting modules for execution. The first instruction set is stripped from the data stream, and the stripped data stream is moved to the second of the plurality of lighting modules. The method may include executing the first instruction block by selectively illuminating a plurality of light emitting diodes (LEDs) associated with the first of the plurality of lighting modules. The method may also include locating the first and second lighting modules at first and second spaced apart locations, respectively.

DETAILED DESCRIPTION OF THE PREFERRED EMBODIMENTS

Figure 1:
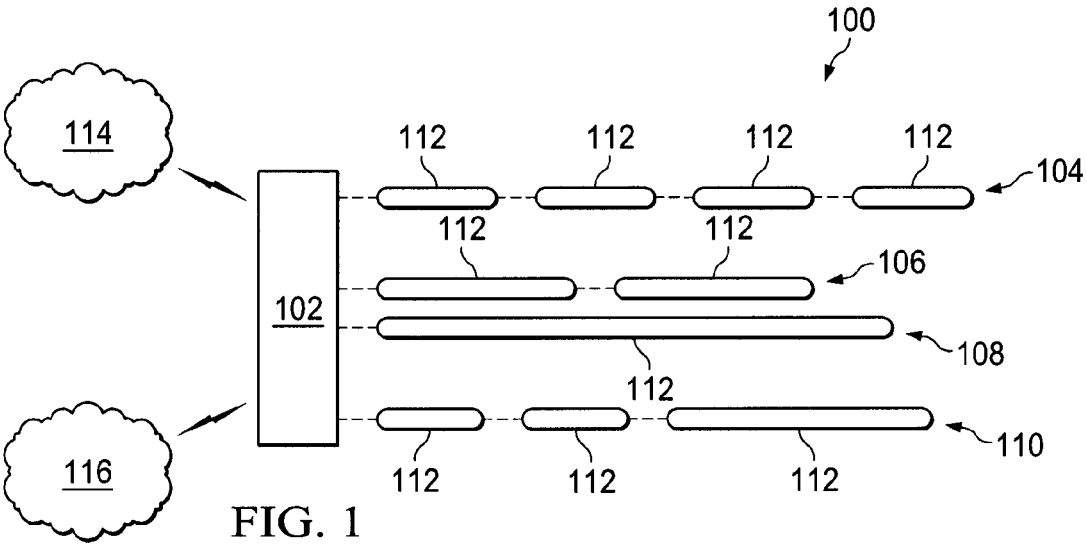
FIG. 1 is a system level diagram of a lighting control system according to the present disclosure.

Referring now to FIG. 1, a system level diagram of a lighting control system according to aspects of the present disclosure is shown. In various embodiments, the system 100 may be utilized to illuminate amusement park rides, store fronts, theme parks, theatres, arcades and other locations. In the present embodiment, the system 100 comprises a control box 102 communicatively coupled to a plurality of lighting modules 112. In the present embodiment, the lighting modules 112 are arranged into a plurality of lighting strips 104, 106, 108, 110. The lighting modules 112 and/or lighting strips 104, 106, 108, 110, may be placed on amusement park rides, arcade games, doorways, paths and any other location in which lighting or lighting effects are desired.

The lighting modules 112 are address-less. For purposes of this disclosure, address-less means that each lighting module 112 within each lighting strip 104, 106, 108, 110, can be controlled to produce illumination and/or lighting effects without the control box 102 associating a particular address with any strip 104, 106, 108, 110 or lighting module 112. Thus, a failure or replacement of any lighting strip 104, 106, 108, 110 or module 112 does not necessitate readdressing or reprograming of any part of the system 100. Particular implementations of this control system will be described in greater detail below. However, the control box 102 can be utilized to provide multiple and various effects within the lighting modules 112 and/or lighting strips 104, 106, 108, 110. Non-limiting examples include chasing, flashing, fading, and music beat effects.

The control box 102 may be a device built and programmed specifically to implement the control system of the present disclosure, or it may be a general purpose device such as a personal computer or headless terminal programmed to provide the appropriate output signals and/or power to the lighting strips 104, 106, 108, 110. In some embodiments the programming of the control box 102 may be altered via a telephone network 114. For example, at pre-programmed intervals the control box 102 may telephone a programming server (not shown) via the telephone network 114 and receive updates. In other embodiments the control box 102 may be attached to the Internet 116 (via Ethernet or wirelessly, for example). The control box 102 may then communicate with an updating server via the Internet 116. In one embodiment, a web interface may be provided such that a user of the system 100 can select new or updated programming using the web browser. The new and/or updated programming will then be provided to the control box 102 via the phone network 114 and/or the Internet 116. In further embodiments, the control box 102 is directly connected to a user's computer and updated via universal serial bus (USB) connection, for example. As with the other updating methods, a web browser may be utilized to obtain the updated programming for the control box 102. In other embodiments a dedicated program could be executed locally for updating the control box 102.

In some embodiments the control box 102 will provide not only the lighting signals, but also the power to the lighting modules 112. As shown in FIG. 1, the lighting modules 112 are arranged in a serial chain configuration and connected end-to-end. Thus, each lighting module 112 may obtain power and control signals either from the control box 102 and/or the lighting module 112 immediately upstream. As will be described in greater detail below, each lighting module 112 will also pass power and/or control signals to the one or more lighting modules 112 that are downstream. It is also understood that the lighting modules 112 may not be arranged in linear fashion as shown, but may be placed in any close or spaced apart location or order desired by the user. So long as each lighting module 112 is connected either to another lighting module or the control box 102, such lighting module 112 may be powered and/or controlled.

Figure 2:
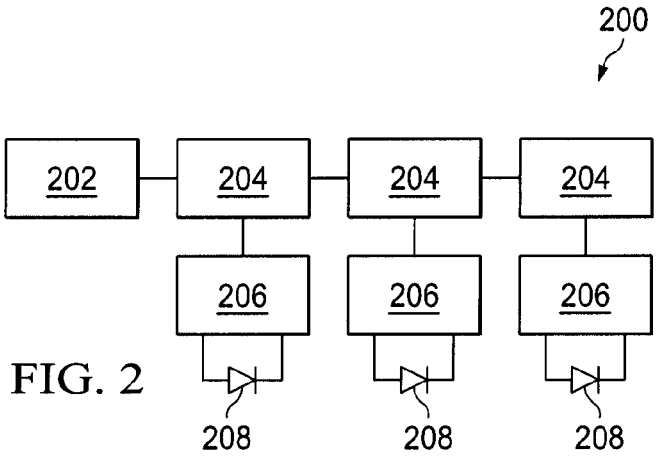
FIG. 2 is a block diagram of the control circuitry of the device of FIG. 1.

Referring now to FIG. 2, a block diagram of the control circuitry of the device of FIG. 1 is shown. In the present embodiment, a microcontroller 202 determines and executes the control scheme of the device 100. In some embodiments the microcontroller 202 is contained within the control box 102. The microcontroller 202 communicates with a series of light emitting diode (LED) drivers 204 that may be located within the lighting modules 112. The microcontroller 202 provides a data stream to the first LED driver 204 that is connected in a chain. Regardless of the length of the provided instruction stream, the LED driver 204 will extract or truncate only a portion of the data stream. Thus, a particular data block within the larger data stream will be utilized by the LED driver 204. Based upon the information contained within the extracted control block, the LED driver 204 will communicate with one or more digital switches 206. The digital switch 206 is connected to the appropriate power supply (possibly coming from the microcontroller 202, LED driver 204, and/or a power bus or power lead) and provides the appropriate electrical voltage and current to drive the LED 208.

Although it is contemplated that each LED driver 204 will take either a first portion or last portion of the received data stream as the data control block, the present disclosure is not meant to be so limited. In the present example, the first LED driver 204 in the chain will then pass the remaining portion of the data stream to the LED driver 204 immediately downstream. The next LED driver 204 will then repeat the process. Thus, the microcontroller 202 and/or the control box 102 can provide a control signal to each LED driver 204, which may be contained in one or more of the lighting modules 112. It can be appreciated that with such a system, if any particular lighting module 112 fails, it may simply be replaced within the appropriate lighting strip 104, 106, 108, 110, without any need for reprogramming or any need for the control box 102 and/or microcontroller 202 to know an address associated with the replacement lighting module.

In the present embodiment, the LED drivers 204 communicate with the attached digital switches 206 via a pulse with modulation protocol. It is understood that each LED driver 204 may be able to control multiple digital switches 206 which in turn could power multiple LEDs 208. Thus the system 100 achieves selective control of all LEDs 208 via the LED drivers 204 and digital switches 206. The LED drivers 204 may be a general-purpose programmable circuit so programed to perform the appropriate functions, or may be based upon an application specific integrated circuit (ASIC). One suitable commercially available LED driver is available from Allegro Microsystems under the part number A6281.

As with the LED drivers 204, it is contemplated that the digital switch 206 may be a general-purpose programmable circuit so programmed to perform the appropriate functions or it could be an ASIC. In the present embodiment, one suitable digital switch capable of providing necessary power output to the appropriate LEDs is available from National Semiconductor Corporation under the part number LM3414. The example parts given enable the system to operate on a wide voltage spectrum. Voltages that produce acceptable results range from 12 VDC to 48 VDC.

It is contemplated that the LEDs 208 may be extra wide angle, 120-degree LEDs. However, other LEDs may also be suitable. It is also contemplated that the LEDs 208 may be provided in a plurality of different colors. As is known in the art, a plurality of LEDs 208 may be provided in close proximity to act as pixels and be able to provide a multitude of additional visible colors other than those of the individual LEDs. Such an arrangement can be provided within and/or between the lighting modules 112.

Figure 3:
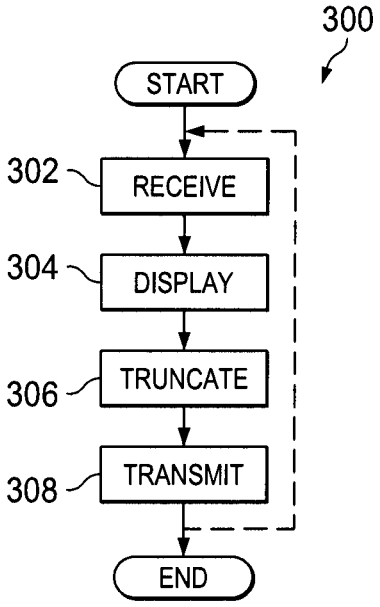
FIG. 3 is a flow chart depicting the operation of part of the control circuitry of FIG. 2.

Referring now to FIG. 3, a flow chart depicting the operation of the control circuitry of FIG. 2 is shown. At the beginning, the appropriate LED driver 204 will receive the data stream at step 302. At step 304 the appropriate control block is extracted (for example, from the beginning or end of the data stream) and the information contained in the data control block is utilized to operate the portion of the display under the control of the receiving LED driver. At step 306, a portion of the data stream containing the executed data block is truncated from the data stream. At step 308, the remaining data stream is then transmitted to the next LED driver in the chain series. It is understood that some of the operations of FIG. 3 could execute in a different order. For example, the data stream could be truncated and retransmitted prior to the LED driver executing the commands contained within the extracted control block.

Figure 4:
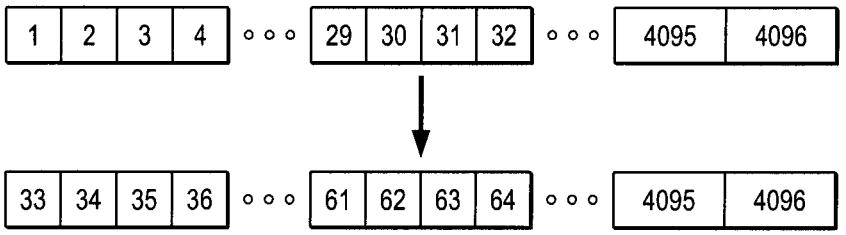
FIG. 4 is a diagram of one embodiment of a data format utilized by the system of the present disclosure.

Referring now to FIG. 4, a diagram of one embodiment of a data format that may be utilized by the system of the present disclosure is shown. In the present example, the construction or data stream is 4,096 bits in length. The data stream may be propagated through the system at various different speeds. In the examples given in the present disclosure, the data stream propagates at a speed of 5 MHz. In FIG. 4, the top portion illustrates the initial full 4,096 bit data stream. This represents the data stream as it would be issued to a particular lighting strip 104, 106, 108, 110, from the control box 102. The lower portion of FIG. 4 illustrates the data stream after it has passed through the first LED driver 204. Thus, the lower portion of FIG. 4 illustrates the data stream as seen by the second LED driver in the chain. Hence, in the present embodiment 32 bits of the data stream have been extracted as the control block for the receiving LED driver 204. The next receiving LED driver 204 may repeat the process by executing the instructions contained in bits 33-64. Such LED driver 204 would then remove bits 33-64 from the data stream before passing it to the following LED driver.

Using the present example, it will be appreciated that up to 128 different LED drivers 204 may be operated or controlled with no addressing required within the data stream. Furthermore, as shown in FIG. 1, a plurality of strips 104, 106, 108, 110, could be connected to a single control box 102. Thus, a large array of discrete LEDs may be operated and controlled from the single control box 102 with no addressing required. It is understood that in other embodiments the data stream may be shorter or longer and the length of the extracted control block may also be longer or shorter.

Figure 5:
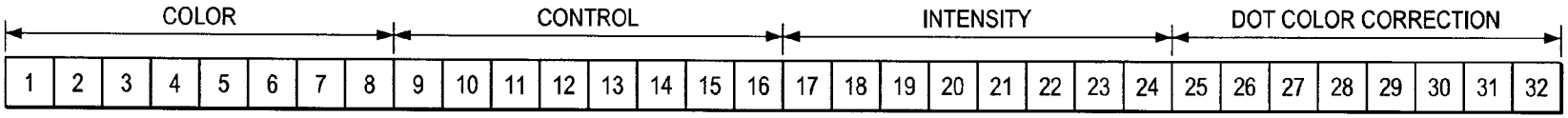
FIG. 5 is another diagram of the potential data format of FIG. 4.

Referring now to FIG. 5, a diagram of a portion of the potential data format of FIG. 4 is shown. In FIG. 5 the first 32 bits of the data stream are shown. As described, this is the portion of the data stream extracted for execution by the first LED driver 204 in the chain. In the present embodiment, the first 8 bits shown in FIG. 5 are designated to control a desired color to be produced by the receiving LED driver 204. As described, each LED driver 204 could be connected to a plurality of different digital switches 206 and/or LEDs 208. Thus, each LED driver 204 may be capable of providing a wide array of different colors. In the present embodiment, the bits 9-16 are designated as control bits. The control bits, 9-16, may be utilized for a wide array of purposes related to the control of the LEDs 208. For example, the control bits 9-16 may encode for flashing or steady illumination, the duration of illumination, whether the illumination ceases abruptly, and/or whether the illumination fades.

Bits 17-24 may encode the intensity of the color to be provided under the current control instruction set. Bits 25-32 may provide for any necessary color correction. It is contemplated that each LED driver 204 within the system 100 may be provided with a different control block. Thus the lighting strips 104, 106, 108, 110, within the larger system 100 may each be coordinated and utilized to produce lighting effects system wide.

Figure 6:
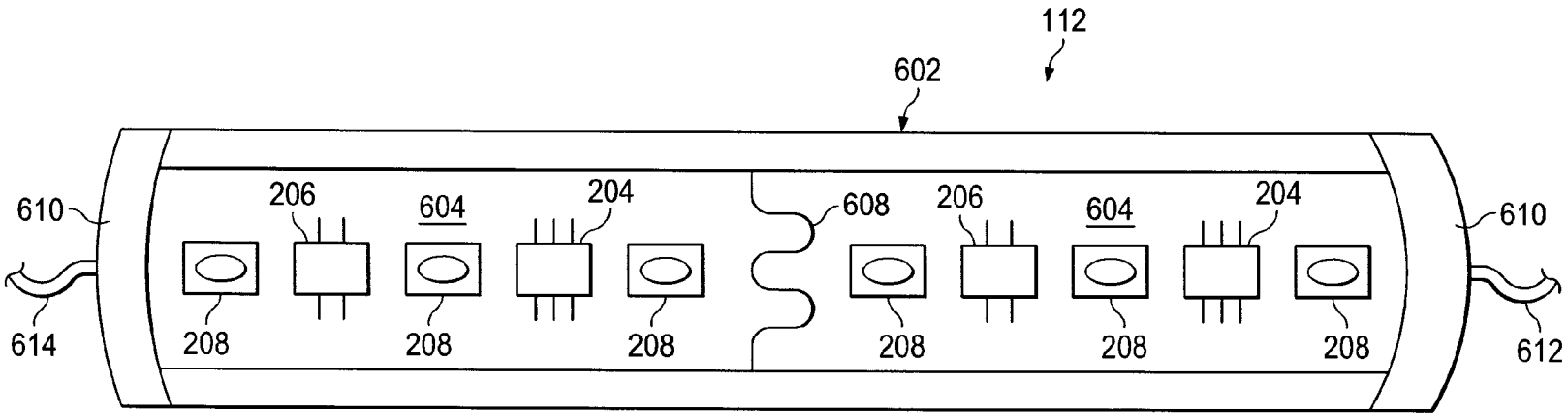
FIG. 6 is a perspective view of a lighting module according to aspects of the present disclosure.

Referring now to FIG. 6, a perspective view of a lighting module according to aspects of the present disclosure is shown. FIG. 6 is meant to illustrate one particular implementation of a lighting module 112. FIG. 6 further illustrates the relationship between the lighting module 112 and the circuitry that may be contained therein. The circuitry may include LED drivers 204, digital switches 206, and/or LEDs 208. In the present embodiment, the lighting module 112 comprises a protective tube 602. The tube 602 may comprise a section of polycarbonate tubing. In one embodiment, the diameter of the tubing will be 1.25 inches. It may be UV rated and impact resistant. In the present embodiment, the tube 602 is substantially transparent. However, it is also possible to utilize a tube 602 that may be translucent, or may be opaque along a portion thereof.

In the present embodiment, the tube 602 contains a number of light strips 604 that may be joined at a connection 608. Each of the light strips 604 contains one or more LEDs 208 that may be surfaced mounted thereto. In the present embodiment, each of the light strips 604 contains its own LED driver 204 and digital switch 206. It will be appreciated that the number of LEDs 208, digital switches 206, and LED drivers 204, is only exemplary. For example, it is possible for a single LED driver 204 to control a plurality of digital switches 206 that may provide power output to a plurality of LEDs 208. It is also understood that a lighting module 112 may be constructed such that each module 112 only contains a single LED driver 204.

In embodiments where multiple light strips 604 are provided within the same tube 602, a connection between the light strips may be provided at 608. It will be appreciated that the connection 608 could be implemented a variety of different ways, depending upon the control path, the power path, and ground path provided. In one embodiment, the connection 608 will be constructed according to United States Patent Application Publication No. US 2012/0073864 A1, the contents of which are hereby incorporated by reference.

In addition to each lighting module 112 possibly having two or more light strips 604 each with one or more LED drivers 204. It is also possible that only a single LED driver 204 may be provided, although there are multiple light strips 604. It is also possible that even when multiple LED drivers 204 are present that only one may be active per lighting module 112. In this way the control over the system 100 may be as finely grained as desired by the user of the system.

In the present embodiment, the tube 602 is capped off by an end cap at each end 610. The caps 610 may be sealed to the tube 602 using chemical sealers or O-rings (not shown) such that the entire tube 602 may be made substantially weather-proof. In this way the system 100 is suitable for use outdoors and in a variety of weather conditions. In the present embodiment, a power and signal input lead 612 is provided on one end of the lighting module 112. A power and signal output line 614 is provided on the opposite end of the lighting module 112. The module 112 may connect and receive power and/or data via the connection 612 from the control box 102 and/or upstream lighting module. Correspondingly, the lighting module 112 may provide outgoing power and control signals via the line 614.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A lighting system comprising:

a lighting module that receives a lighting instruction set of a digital instruction stream that is transmitted sequentially through a plurality of lighting modules, the digital instruction stream comprising a plurality of lighting instruction sets, wherein each of the plurality of lighting instruction sets comprises 32 bits of data specifically exclude addressing information for any of the plurality of lighting modules.

2. The lighting system of claim 1, wherein the lighting module further comprises a light emitting diode (LED) driver that receives the instruction stream, extracts the portion of the stream comprising one of the plurality of lighting instruction sets, and provides the remainder of the stream to the connected adjacent lighting module.

3. The lighting system of claim 2, further comprising a digital switch connected to the LED driver, and at least one LED attached to the digital switch, the digital switch providing electrical energy for powering the at least one LED in response to a signal from the LED driver.

4. The lighting system of claim 3, wherein the at least one LED comprises a plurality of sequentially connected LEDs of having a plurality of colors.

5. The lighting system of claim 1, wherein the lighting module further comprises a weather sealed partially transparent tube containing a plurality of light emitting diodes (LEDs), an integrated 32 bit LED driver, and three separate constant current power supplies to drive the LEDs.

6. The lighting system of claim 5, wherein the integrated 32 bit LED driver within the tube that receives the digital instruction stream comprising the plurality of lighting instruction sets, extracts one of the plurality of lighting instruction sets, and provides a remainder of the stream to a connected adjacent lighting module.

7. The lighting system of claim 6 further comprising at least one digital switch within the tube and connected between the integrated 32 bit LED driver at least one of the plurality of sequentially connected LEDs, the integrated 32 bit LED driver executing the extracted lighting instruction set via control of the digital switch to selectively illuminate the plurality of sequentially connected LEDs.

8. The lighting system of claim 7, wherein the integrated 32 bit LED driver outputs control signals directly to three separate constant current power supplies via pulse width modulation.

9. The lighting system of claim 6, wherein the digital instruction stream comprises a beginning and an end, wherein the one of the plurality of lighting instruction sets that is extracted is extracted from the end of the digital instruction stream rather than the beginning.

10. The lighting system of claim 1, further comprising a digital controller communicatively coupled to the lighting module and providing the digital instruction stream to each of a plurality of LEDs within the lighting module.

11. The lighting system of claim 10, wherein the digital controller receives the digital instruction stream via the Internet.

12. The lighting system of claim 10, wherein the digital controller receives the digital instruction stream wirelessly.

13. The lighting system of claim 1, wherein the first set of eight bits, second set of eight bits, third set of eight bits, and fourth set of eight bits are arranged sequentially in numerical order.

14. An address-less lighting system comprising:

a plurality of lighting modules, each comprising a light emitting diode (LED) driver, a digital switch coupled to the LED driver, and at least one LED coupled to the digital switch; and a system controller:

obtaining a count of a number of the plurality of lighting modules, prior to transmitting to the plurality of lighting modules a digital data instruction stream;

providing the digital data instruction stream to the plurality of lighting modules without addressing data, wherein the digital data instruction stream comprises sequentially connected 32 bit instructions sets that each comprise bits 1-8 that specify a light color for a light driver, bits 9-16 that are control set, bits 17-24 that encode intensity of color under the control set, and bits 25-32 that defines color corrections;

wherein the plurality of lighting module are connected in a serial chained configuration, a first lighting module in the chain receiving the digital data instruction stream from the system controller, extracting a portion one of the sequentially connected 32 bit instructions of the received digital data instruction stream for use by the first module in the chain and passing a remainder of the data to a next lighting module in the chain.

15. The system of claim 14, wherein each of the plurality of lighting modules contains the LED driver, the digital switch, and the at least one LED in a weather proof enclosure.

16. The system of claim 14, wherein the digital controller obtains a count of a number of lighting modules connected in the serial chained configuration before providing the digital data instruction stream.

17. A method of controlling a plurality of lighting modules, each module having a plurality of lights that may be illuminated in a plurality of ways, the method comprising:

designating a first instruction block for a first of the plurality of lighting modules and a second instruction block for a second of the plurality of lighting modules, each of the first and second instruction blocks comprising 32 bits of data that specifically exclude addressing information for any of the plurality of lighting modules, and comprise bits 1-8 that specify a light color for a light driver, bits 9-16 that are control set, bits 17-24 that encode intensity of color under the control set, and bits 25-32 that defines color corrections;

appending the second instruction block to the first instruction block to create a data stream;

providing the data stream to the first of the plurality of lighting modules for execution;

transmitting the second instruction block of the data stream from the first of the plurality of lighting modules to the second of the plurality of lighting modules; and moving the stripped data stream to the second of the plurality of lighting modules.

18. The method of claim 17, further comprising executing the first instruction block by selectively illuminating a plurality of light emitting diodes (LEDs) associated with the first of the plurality of lighting modules.

19. The method of claim 17, further comprising locating the first and second lighting modules at first and second spaced apart locations, respectively.

* * * * *